US005851155A

United States Patent [19]

Wood et al.

[11] Patent Number: 5,851,155

[45] Date of Patent: Dec. 22, 1998

[54] HOSEL CONSTRUCTION AND METHOD OF MAKING THE SAME

[75] Inventors: Donald C. Wood; David W. Means, both of Carlsbad, Calif.

[73] Assignee: Zevo Golf Co., Inc., Temecula, Calif.

[21] Appl. No.: 923,546

[22] Filed: Sep. 4, 1997

[51] Int. Cl.[6] ..... A63B 53/02

[52] U.S. Cl. ..... 473/246; 473/288; 473/307; 473/409

[58] Field of Search ..... 473/324, 305, 473/306, 307, 308, 309, 310, 313, 314, 287, 288, 245, 246, 248, 409

[56] References Cited

U.S. PATENT DOCUMENTS

| | | | |
|---|---|---|---|
| 1,426,202 | 8/1922 | Lard . | |
| 1,540,559 | 10/1925 | Murphy . | |
| 1,818,359 | 8/1931 | Samaras | 473/245 |
| 2,027,452 | 1/1936 | Rusing | 473/246 |
| 2,067,556 | 1/1937 | Wettlaufer . | |
| 2,326,495 | 8/1943 | Reenstierna | 473/245 |
| 2,425,808 | 8/1947 | Jakosky | 473/246 |
| 2,708,579 | 5/1955 | Hugman | 473/246 |
| 3,909,005 | 9/1975 | Piszel | 473/248 |
| 3,980,301 | 9/1976 | Smith . | |
| 4,895,368 | 1/1990 | Geiger . | |
| 4,984,794 | 1/1991 | Pernelle et al. . | |
| 5,511,779 | 4/1996 | Meyers | 473/246 |
| 5,513,844 | 5/1996 | Aschcraft et al. . | |
| 5,542,666 | 8/1996 | Chou . | |

FOREIGN PATENT DOCUMENTS

| | | |
|---|---|---|
| 2241173 | 8/1991 | United Kingdom . |

*Primary Examiner*—Sebastiano Passaniti
*Attorney, Agent, or Firm*—Higgs, Fletcher & Mack LLP; Bernard L. Kleinke; William J. Kolegraff

[57] ABSTRACT

The hosel construction includes a plug member extending downwardly for engaging a club head having a club face. A neck member, extending angularly upwardly from the plug member, engages a shaft to complete a golf club. The neck member extends in a generally transverse dimension to determine a lie angle between the shaft and the club head. The neck member also extends in a generally longitudinal dimension to determine a longitudinal angle, such as a face angle for the club face.

9 Claims, 2 Drawing Sheets

HOSEL CONSTRUCTION AND METHOD OF MAKING THE SAME

TECHNICAL FIELD

The present invention relates in general to an improved golf club hosel construction and method of a method of making it. The invention more particularly relates to a hosel construction which can be used to fit golf clubs to individual golfers, and which can be made according to a novel method.

BACKGROUND ART

In order to accommodate the largest possible percentage of the population of golfers, off-the-shelf golf clubs have been manufactured to have physical properties for use by a typical golfer having typical golfing characteristics. The golfing characteristics affected the physical properties of the golf clubs, e.g., shaft length, lie angle, and face angle, and included the height of the golfer, the position of the golfer when addressing a golf ball, the swing path of the golf club, the swing height of the club head, etc. Using the typical golfing characteristics to produce off-the-shelf golf clubs having standard physical properties reduced the manufacturing costs of the clubs and enabled the golf club manufacturers to sell the golf clubs at a relatively low cost.

While such an approach provided the majority of golfers with access to relatively inexpensive golf clubs, the off-the-shelf golf clubs were not ideally suited for all golfers. In this regard, a golfer whose golfing characteristics deviated from the typical golfing characteristics was not able to utilize the off-the-shelf golf clubs to perform at the highest level possible. To achieve peak performance levels, the golfer was required to adjust his or her golfing characteristics to match the typical golfing characteristics embodied in the off-the-shelf golf clubs.

The adjusting of golfing characteristics required instruction and substantial time devoted to the adjustment. In an effort to avoid the time and expense involved in the adjustment of golfing characteristics, golfers turned to customized golf clubs designed specifically for the golfing characteristics of the individual golfer. With the customized golf clubs the golfer was able to utilize his or her own individual golfing characteristics to obtain peak performance without adjusting the individual golfing characteristics.

Generally, the customized golf clubs utilized a club head having an upwardly extending hosel portion for connecting the club head to a shaft. Each individual golfer required a particular relationship between the club head and the hosel portion. Thus, to accommodate as many golfers as possible, an assembler of custom fitted golf clubs had to either maintain a large inventory of all possible combinations of club head/hosel portion relationships, or manufacture each one of the required club heads having the appropriate club head/hosel portion relationship as required.

Although the customized golf clubs enabled all golfers to obtain golf clubs suited for the golfer's individual golfing characteristics, such customized golf clubs were relatively expensive. Furthermore, the assembly of such customized golf clubs required a substantial amount of time to complete.

Therefore, it would be highly desirable to have a new and improved hosel construction for assembling customized golf clubs, and which can be made according to a novel method. Such a hosel construction should enable customized golf clubs to be produced with greater precision in a relatively inexpensive manner, and should enable the customized golf clubs to be assembled quickly and easily.

SUMMARY OF THE INVENTION

Therefore, the principal object of the present invention is to provide a new and improved hosel construction and a method of making it, wherein the hosel construction facilitates the production of customized or fitted golf clubs in a relatively quick and inexpensive manner, and with greater precision.

Briefly, the above and further objects of the present invention are realized by providing a new and improved hosel construction, which can be made according to a novel method of the present invention.

The hosel construction includes a plug member extending downwardly for engaging a club head having a club face. A neck member, extending angularly upwardly from the plug member, engages a shaft to complete a golf club. The neck member extends in a generally transverse dimension to determine a lie angle between the shaft and the club head. The neck member also extends in a generally longitudinal dimension to determine a face angle for the club face.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
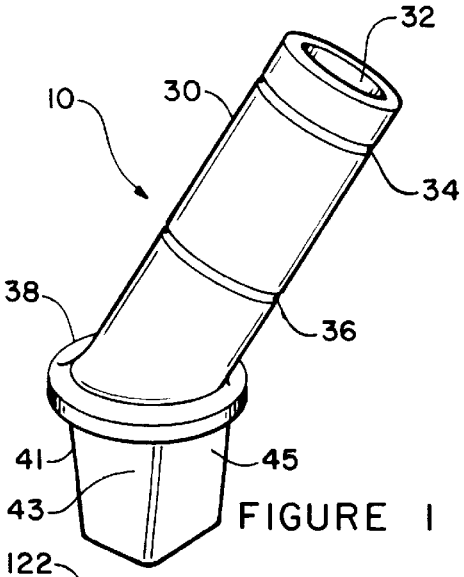
FIG. 1 is an enlarged perspective view of a hosel construction, which is constructed in accordance with the present invention.
Figure 4:
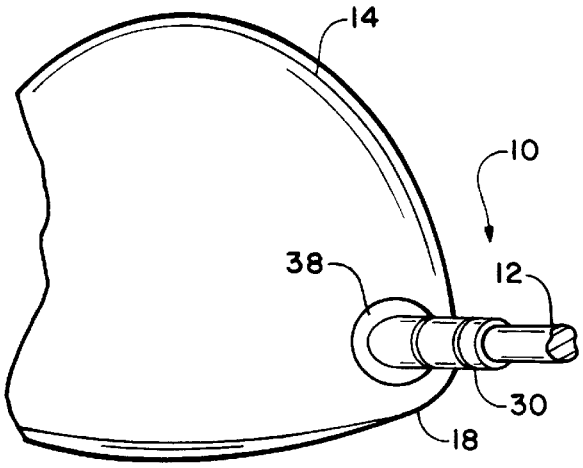
FIG. 4 is a cut-away plan view of the golf club of FIG. 2.

Referring now to the drawings, and more particularly to FIGS. 1–4 thereof, there is shown a hosel construction 10, which is constructed in accordance with the present invention. The hosel construction 10 facilitates the construction of a customized or fitted golf club for an individual golfer using a standard golf club shaft 12 and a standard golf club head 14.

As shown in FIGS. 1–4, the club head 14 is indicative of a wood type of golf club. The club head 14 includes a generally vertical upwardly directed opening at a heel portion 18 of the club head 14, and club face 16 having an associated face angle.

The hosel construction 10 cooperates with the shaft 12 and the club head 14 to angularly position the shaft 12 relative to the club head 14 to a desired lie angle. The hosel construction 10 also angularly positions the club face 16 to a desired face angle. The desired lie angle and desired face angle determine the physical properties of the fitted golf club to accommodate the golfing characteristics of the individual golfer.

As used herein, all directions are described relative to the club head 14 (FIG. 4), wherein the club face 16 is at the front of the club head 14 and the hosel construction is at the left side of the club head 14. Thus, a longitudinal dimension is defined through the front and back of the club head 14 and a transverse dimension is defined relative to the longitudinal dimension.

The hosel construction 10 includes a generally downwardly extending club head engaging portion, or plug member 41, adapted to be received in the opening in the heel portion 18. The plug member 41 includes a plurality of sides, such as front side 43 and left side 45. The opening in the heel portion 18 has a corresponding number of sides to enable the plug member 41 to be received in the opening, wherein the engagement of the sides 43 and 45 with corresponding sides in the opening substantially limits the rotation of the hosel construction 10 within the opening in the heel portion 18. It will be understood by one skilled in the art that the plug member 41 could also be circular or ovate with only one side.

The hosel construction 10 further includes a shaft engaging member, or neck member 30, extending generally angularly upwardly from the plug member 41. The neck member 30 is generally cylindrical and defines an opening 32 for receiving the shaft 12 therein. The neck member 30 further includes a pair of ornamental grooves 34 and 36 circumscribing the neck member 30. In order to facilitate obtaining the desired lie angle and the desired face angle for the particular golfer, the neck member 30 extends in the generally transverse dimension, and also extends in the generally longitudinal dimension, relative to the plug member 41

Figure 2:
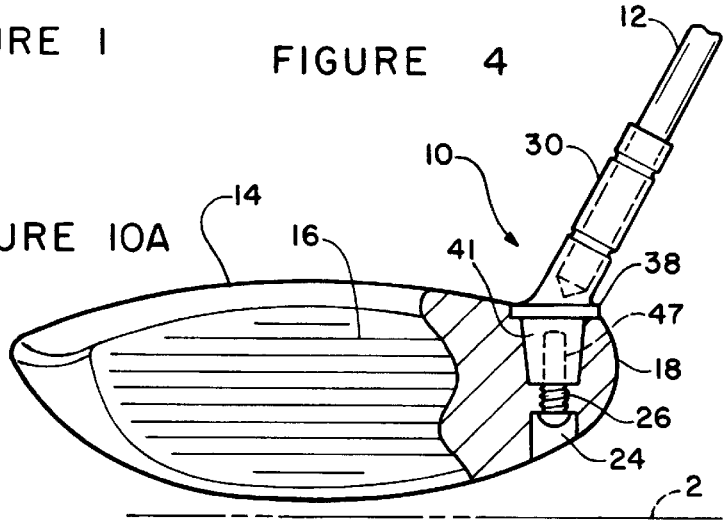
FIG. 2 is a partially cut-away front elevational view of a fitted golf club utilizing the hosel construction of FIG. 1.

As best seen in FIG. 2, the neck member 30 extends upwardly and angularly outwardly in the transverse dimension away from the plug member 41 to define the desired lie angle between the shaft 12 and the club head 14. The neck member 30 (FIG. 3) also extends upwardly and rearwardly from the plug member 41 in the longitudinal dimension to position the club face 16 at the desired face angle. In this regard, to maintain the shaft 12 in a substantially upright position, the club head 14 is reoriented counter-clockwise in the longitudinal dimension to position the club face 16 at the desired face angle. As the standard face angle is defined when the club head 14 is substantially parallel to a ground surface 2, the rearward extension of the neck member 30 in the longitudinal dimension represents the degrees of rotation of the club face 16 necessary to position the club face 16 at the desired face angle from the standard face angle. The counter-clockwise reorientation of the club head 14 results in the face angle being increased toward a hook position from the standard face angle. The face angle is the angle between the face and the shaft of the club.

Similarly, the outward extension of the neck member 30 in the transverse dimension reorients the club head 14 about its heel 18 in the transverse dimension to position the neck member 30 at the desired lie angle. The degrees of reorientation in the transverse dimension are preferably determined relative to a standard lie angle. A progressive scale is also contemplated. As shown in FIG. 2, the neck member 30 is reoriented to increase the lie angle from the standard lie angle.

The hosel construction 10 further includes a boss 38 disposed about an upper portion of the plug member 41 to engage a reveal encircling the opening at the heel 18 of the club head 14 when the plug member 41 is received within the opening in the heel portion 18. The plug member 41 further includes a threaded opening 47 for receiving a screw 26 to secure the hosel construction 10 to the club head 14, wherein the screw 26 extends from a counter bore 24 through a bore and into the threaded opening 47. While in the preferred embodiment the threaded screw 26 is utilized, other securing devices and methods such as adhesives and rivets are also contemplated.

Preferably, the hosel construction 10 is fabricated or machined in one piece from a metallic material. However, other materials such as thermoplastics, carbon-graphite, are also contemplated within the scope of the invention.

Referring now to FIGS. 5–8, there is shown another hosel construction 50 which is also constructed in accordance with the present invention. The hosel construction 50 is adapted to be received within an opening in a club head 62 for connecting the club head 62 to a shaft 60 to form a fitted golf club. The club head 62 is substantially similar to the club head 14 (FIGS. 2–4), and includes a generally vertical upwardly extending opening for receiving the hosel construction 50 and a club face 64 disposed at a face angle.

The hosel construction 50 is substantially similar to the hosel construction 10 (FIGS. 1–4) and includes a downwardly extending plug member 56, a boss member 54 disposed about an upper portion of the plug member 56, and a neck member 52 extending generally angularly upwardly from the plug member 56. The neck member 52 extends generally in the transverse dimension relative to the plug member 56 to orient the shaft 60 at a desired lie angle relative to the club head 62. The neck member 52 further extends generally in the longitudinal dimension relative to the plug member 56 to orient the club face 64 at a desired face angle.

Figure 6:
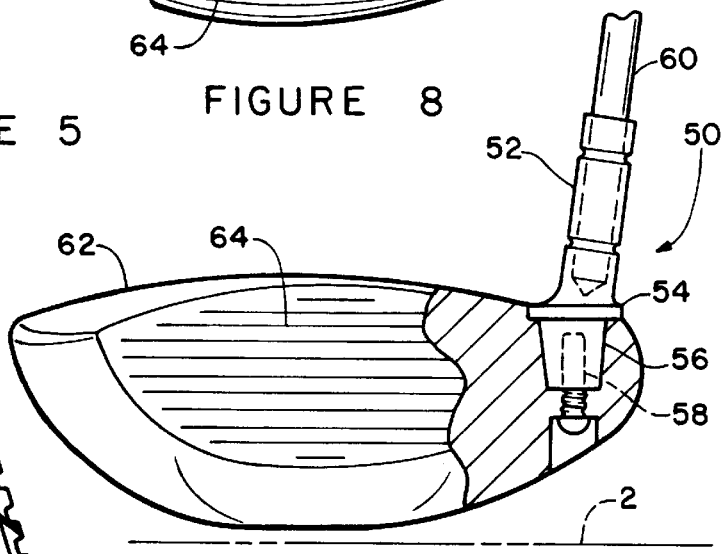
FIG. 6 is a partially cut-away front elevational view of a fitted golf club utilizing the hosel construction of FIG. 5.

Although the neck member 52 extends outwardly in the longitudinal dimension, a comparison of FIGS. 2 and 6 shows the neck member 52 (FIG. 6) does not extend outwardly in the transverse dimension to the extent that the neck member 30 (FIG. 2) does. As a result, the desired lie angle produced by the hosel construction 50 is less than the desired lie angle produced by the hosel construction 10. As shown in FIG. 6, the neck member 52 is reoriented inwardly from the standard lie angle position. Thus, the lie angle is decreased from the standard lie angle to obtain the desired lie angle.

In addition, the neck member 52 extends generally forwardly in the longitudinal dimension to increase the face angle relative to the standard face angle. Thus, by reorienting the club head 62 clockwise in the longitudinal dimension while maintaining the shaft 60 in a substantially upright position, the face angle is decreased from the standard face angle to obtain the desired face angle.

The hosel construction 50 is secured to the club head 62 by a screw 58 or other securing devices or methods.

The hosel constructions 10 (FIGS. 1–4) and 50 (FIGS. 5–8) illustrate only two possible configurations. Further configurations can be obtained by combining either positive or negative deviations of the lie angle and the face angle from the standard lie angle and standard face angle. In addition, the amount of deviation, either positive or negative, can be adjusted. Of course, another configuration could be obtained with no deviation, i.e., the desired face angle and desired lie angle correspond to the standard face angle and standard lie angle, respectively. In this way, any possible number of desired lie angles or desired face angles can be achieved for an individual golfer using a standard club head, such as club heads 14 and 62, and standard shafts, such as shafts 12 and 60.

Although a right-handed wood type of golf club is shown in FIGS. 1–8, it will be understood by one skilled in the art that other types of golf clubs, such as irons and putters, can also be customized or fitted using the disclosed hosel construction. In addition, left-handed fitted golf clubs can be assembled with the hosel construction of the present invention.

In order to assemble a custom or fitted golf club for a particular golfer, a desired lie angle and a desired face angle must be determined for the golfer. The desired lie angle and the desired face angle for the golfer can be determined according to the method and apparatus for fitting golf clubs to golfers disclosed in co-pending and co-owned U.S. patent application Ser. No. 08/799,072, filed Feb. 11, 1997, which application is incorporated by reference as if fully set forth herein.

Utilizing the known standard characteristics of the standard golf club head and the standard shaft, such as the standard face angle and standard lie angle, an appropriate hosel construction, such as hosel constructions 10 and 50, can be selected to position the club head to the desired lie angle and the desired face angle. In this regard, to obtain the desired lie angle, it may be necessary to select a hosel construction that will increase or decrease the lie angle relative to the standard lie angle to obtain the desired lie angle. Similarly, it may be necessary to select a hosel construction that will increase or decrease the face angle relative to the standard face angle to obtain the desired face angle. As illustrated by hosel constructions 10 and 50, a single hosel construction can accomplish both adjustments of the lie and face angle.

In order to accommodate a wide variety of golfing characteristics for individual golfers using standard club heads and shafts, a plurality of hosel constructions having different combinations for obtaining desired lie angles and desired face angles can be utilized. The degrees of deviation from standard lie and face angles for such hosel constructions are set forth below in Table 1. Only the combinations using deviations of 1°, 0° and −1° are shown. However, additional increments, positive and negative, integer and non-integer, are also contemplated.

TABLE 1

| Hosel | Lie Angle Deviation | Face Angle Deviation |
|---|---|---|
| 1 | −1° | −1° |
| 2 | −1° | 0° |
| 3 | −1° | +1° |
| 4 | 0° | −1° |
| 5 | 0° | 0° |
| 6 | 0° | +1° |
| 7 | +1° | −1° |
| 8 | +1° | 0° |
| 9 | +1° | 1° |

The following example illustrates the selection of the appropriate hosel construction for a fitted golf club. The golf club to be fitted is a six iron having a standard lie angle of 55° and a standard face angle of 0°. The desired lie angle and desired face angle are determined to be 56° and −10° for a hooked face, respectively, for the individual golfer. Using Table 1, it is determined that the use of hosel construction number 7 will increase the lie angle to the desired lie angle from the standard lie angle. Hosel construction number 7 will also decrease the face angle from the standard face angle to the desired face angle.

After selection of the appropriate hosel construction, the selected hosel construction is coupled between the standard club head and the shaft to produce the customized or fitted golf club for the golfer. Further adjustments, such as lengthening or shortening the shaft length may also be required. In this way, the same golf club and shaft can be utilized to assemble, quickly and easily, a fitted club for any one golfer out of the entire population of golfers.

Figure 10A:
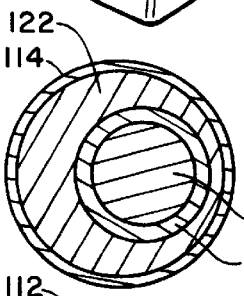
FIGS. 10A–B are cross sectional views of the hosel construction of FIG. 9, taken substantially along line 10A–B thereof.
Figure 10B:
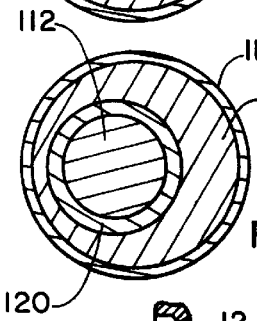
Figure 3:
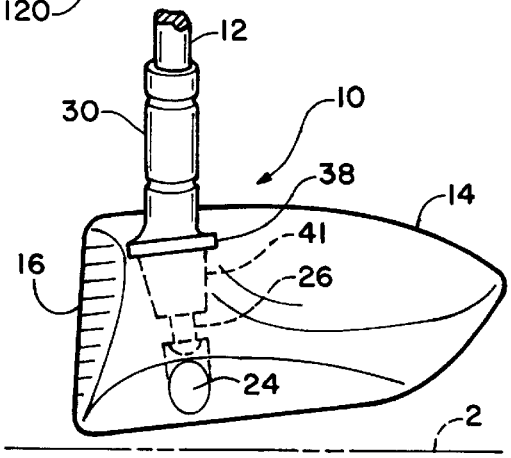
FIG. 3 is a left side elevational view of the golf club of FIG. 2.
Figure 7:
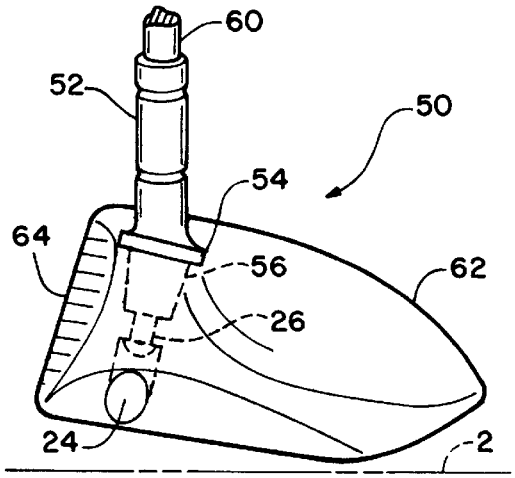
FIG. 7 is a left side elevational view of the golf club of FIG. 6.
Figure 5:
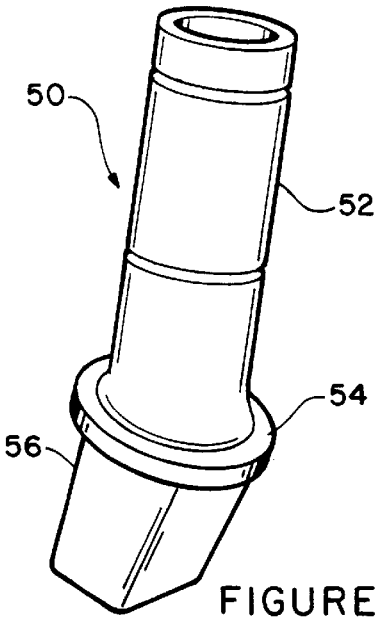
FIG. 5 is an enlarged perspective view of another hosel construction, which is also constructed in accordance with the present invention.
Figure 8:
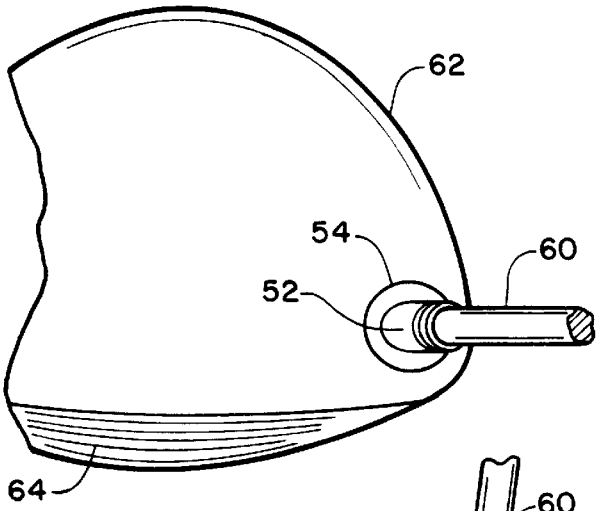
FIG. 8 is a cut-away plan view of the golf club of FIG. 6.
Figure 9:
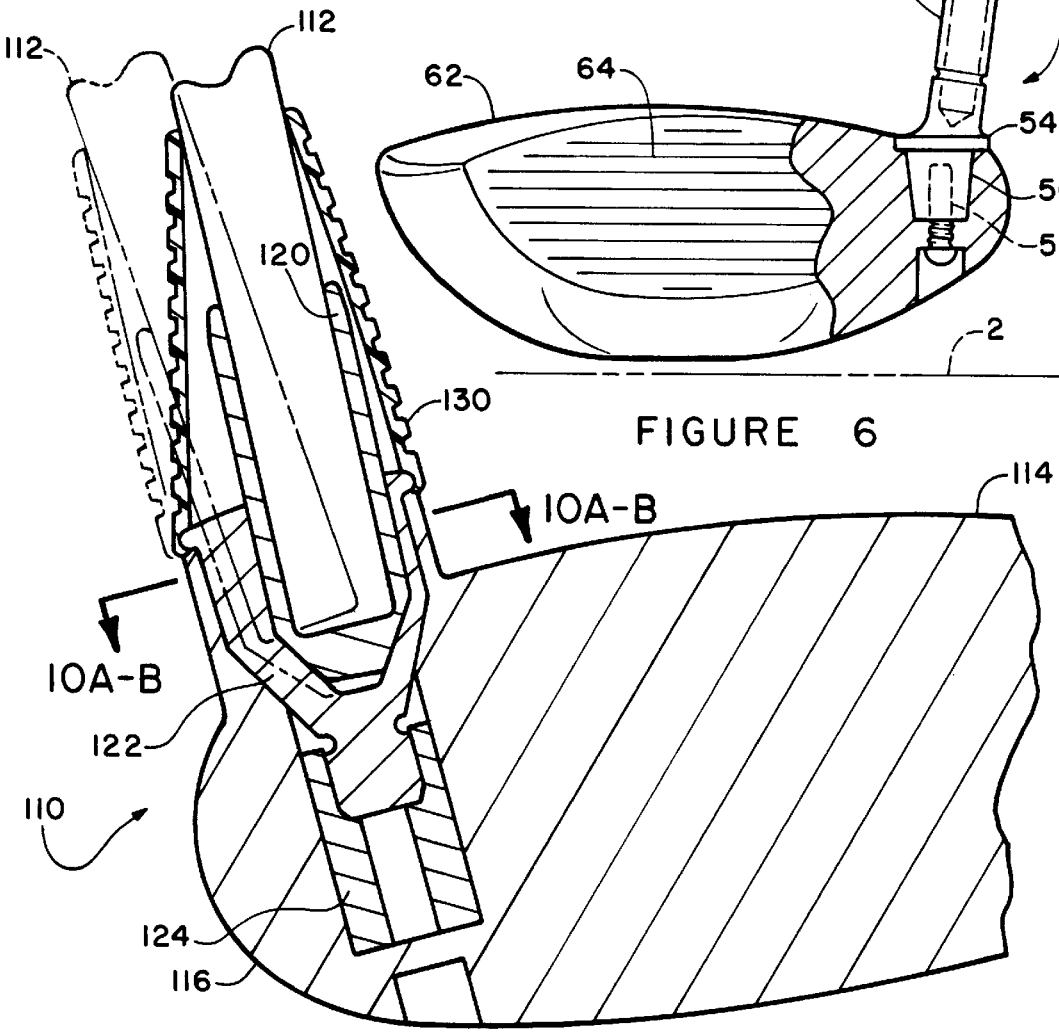
FIG. 9 is an enlarged sectional elevational view of another hosel construction, which is also constructed in accordance with the present invention.

Referring now to the drawings, and more particularly to FIGS. 9 and 10A–B, there is shown another hosel construction 110 for coupling a standard shaft 112 to a standard club head 114. The hosel construction 110 is similar to the hosel constructions 10 and 50 (FIGS. 1–8) and facilitates the assembly of a fitted golf club having a desired lie angle and a desired face angle. The hosel construction 110 is received within an opening in a heel portion 116 of the club head 114, and is secured therein by a securing screw (not shown) or other securing devices or methods.

The hosel construction 110 includes a shaft engaging or neck member 120 and a head engaging or plug member 122 having an offset opening to receive the neck member 120 therein. A longitudinal axis of the opening in the plug member 122 intersects a longitudinal axis of the plug member 122, wherein the opening is slanted relative to the plug member 122.

As best seen in FIGS. 10A–B, the plug member 122 is substantially circular. As shown in solid lines in FIG. 9, the slanted opening in the plug member 122 causes the neck member 120 to extend generally inwardly in a transverse dimension. As a result, the neck member 120 and the shaft 112 are offset inwardly from the longitudinal axis of the plug member 122 (FIG. 10A). Similarly, when plug member 122 is rotated 180° to the position shown in dashed lines in FIG. 9, the opening in the plug member 122 urges the neck member 120 outwardly in the transverse dimension, wherein the neck member 120 and shaft 112 are offset outwardly from the longitudinal axis of the plug member 122 outwardly (FIG. 10B).

While particular embodiments of the present invention have been disclosed, it is to be understood that various different modifications are possible and are contemplated within the true spirit and scope of the appended claims. For example, the present invention applies to both woods and irons, and it will become apparent to those skilled in the art, that the terms "loft angle" apply more appropriately to an iron. Thus, the terms "longitudinal angle" as used in the claims are intended to apply to both woods and irons. There is no intention, therefore, of limitations to the exact abstract or disclosure herein presented.

What is claimed is:

1. A hosel construction for connecting a shaft to a club head having a generally upwardly directed opening and a club face, comprising:

a plug member adapted to be received in the opening;

a neck member extending generally angularly relative to said plug member for engaging the shaft;

said neck member extending in a generally tranverse dimension to position the shaft at a desired lie angle relative to the club head; and said neck member extending in a generally longitudinal dimension to position the club face at a desired longitudinal angle;

wherein said plug member is connected integrally to said neck member; and wherein a reveal is disposed about the opening, further including a boss portion disposed about an upper end of said plug member to engage the reveal.

2. A hosel construction for connecting a shaft to a club head having a generally upwardly directed opening and a club face, comprising:

a plug member adapted to be received in the opening;

a neck member extending generally angularly relative to said plug member for engaging the shaft;

said neck member extending in a generally tranverse dimension to position the shaft at a desired lie angle relative to the club head; and said neck member extending in a generally longitudinal dimension to position the club face at a desired longitudinal angle; and wherein said plug member has an associated plug member longitudinal axis and includes means for defining a cavity having a cavity longitudinal axis intersecting said plug member longitudinal axis, said neck member being received within said cavity.

3. A hosel construction according to claim 2, wherein said plug member is positionable within the opening to orient said cavity longitudinal axis for positioning the shaft at said desired lie angle.

4. A hosel construction according to claim 2, further including a connector member adapted to be received within the opening for engaging said plug member.

5. A hosel construction according to claim 2, further including means for securing said plug member within the opening.

6. A hosel construction according to claim 2, further including a boot for enclosing said plug member and said neck member.

7. A method of constructing a fitted golf club for a golfer, comprising:

using a shaft and a club head having a generally upwardly directed opening and a club face, a plurality of hosel constructions, each of said hosel constructions including a generally downwardly extending plug member, a neck member extending generally angularly upwardly from said plug, said neck member extending in a generally transverse dimension, and said neck member extending in a generally longitudinal dimension;

determining a desired lie angle for the golfer;

determining a desired longitudinal angle for the golfer;

selecting one of said hosel constructions for coupling said shaft to said club head, said selected hosel construction having said neck member extending in said transverse dimension to position said shaft relative to said club head at said desired lie angle, and further having said neck member extending in said longitudinal dimension to position the club face at said desired longitudinal angle;

engaging said club head with said plug member; and engaging said shaft with said neck member.

8. A method according to claim 7, wherein said selecting includes determining a lie angle adjustment to obtain said desired lie angle.

9. A method according to claim 7, wherein said selecting includes determining a face angle adjustment to obtain said desired longitudinal angle.

* * * * *